US009523232B2

(12) United States Patent
Han et al.

(10) Patent No.: US 9,523,232 B2
(45) Date of Patent: Dec. 20, 2016

(54) FILLING MATERIAL, WINDOW AND DOOR SET, AND FILLING METHOD

(71) Applicant: KOREA INSTITUTE OF CONSTRUCTION TECHNOLOGY, Goyang-si, Gyeonggi-do (KR)

(72) Inventors: Jae-yong Han, Seongnam-si (KR); Si-won Kum, Yongin-si (KR); Jae-sik Kang, Incheon (KR)

(73) Assignee: Korea Institute of Construction Technology, Goyang-si, Gyeonggi-do (KR)

( * ) Notice: Subject to any disclaimer, the term of this patent is extended or adjusted under 35 U.S.C. 154(b) by 0 days.

(21) Appl. No.: 14/438,842

(22) PCT Filed: Oct. 7, 2013

(86) PCT No.: PCT/KR2013/008948
§ 371 (c)(1),
(2) Date: Apr. 27, 2015

(87) PCT Pub. No.: WO2014/065521
PCT Pub. Date: May 1, 2014

(65) Prior Publication Data

US 2015/0292255 A1 Oct. 15, 2015

(30) Foreign Application Priority Data

Oct. 26, 2012 (KR) ..... 10-2012-0119791

(51) Int. Cl.
*E04B 1/68* (2006.01)
*E06B 1/58* (2006.01)
(Continued)

(52) U.S. Cl.
CPC . *E06B 1/58* (2013.01); *E04B 1/82* (2013.01); *E04B 1/948* (2013.01); *E06B 1/62* (2013.01); *E06B 2001/626* (2013.01)

(58) Field of Classification Search
CPC ..... E06B 1/58; E06B 1/62; E06B 2001/626; E04B 1/948; E04B 1/82
(Continued)

(56) References Cited

U.S. PATENT DOCUMENTS 3,854,253 A * 12/1974 Slowbe ..... E04B 2/56 52/2.15
4,679,373 A * 7/1987 Ludwig ..... E04F 21/0015 52/2.12
(Continued)

FOREIGN PATENT DOCUMENTS

CH DE 4122532 A1 * 12/1992 ..... B02C 18/148
DE 1059166 B * 6/1959 ..... E06B 1/62
(Continued)

*Primary Examiner* — Adriana Figueroa
(74) *Attorney, Agent, or Firm* — Novick, Kim & Lee, PLLC; Jae Youn Kim

(57) ABSTRACT

A filling material according to an embodiment of the invention includes: an outer cover material having elasticity; an expansion material being inserted into an inside of the outer cover material, wherein the expansion material being compressed when the inside of the outer cover material is evacuated; a nozzle being provided at one end of the outer cover material, wherein air is evacuated from the inside of the outer cover material or air is injected to the inside of the outer cover material to expand the outer cover material through the nozzle; and a stopper for blocking the nozzle in a state that the inside of the outer cover material is evacuated to maintain the inside of the outer cover material to be vacuous.

16 Claims, 6 Drawing Sheets

(51) Int. Cl.
*E06B 1/62* (2006.01)
*E04B 1/82* (2006.01)
*E04B 1/94* (2006.01)

(58) Field of Classification Search
USPC ..... 277/644, 645, 646
See application file for complete search history.

(56) References Cited

U.S. PATENT DOCUMENTS 4,936,512 A * 6/1990 Tremoulet, Jr. ..... B05B 1/00 239/596
5,072,952 A * 12/1991 Irrgeher ..... E04B 1/6812 277/652
5,968,615 A * 10/1999 Schlappa ..... E04B 1/948 428/192
6,572,948 B1 * 6/2003 Dykhoff ..... A62C 2/065 169/56
8,341,908 B1 * 1/2013 Hensley ..... E04B 1/6804 404/68

FOREIGN PATENT DOCUMENTS

DE 10309740 A1 * 9/2004 ..... E04F 21/06
DK WO 9513448 A1 * 5/1995 ..... E04F 21/0007
JP 63-002751 U 1/1988
JP 09-508193 A 8/1997
JP 2001-108110 A 4/2001
KR 20-1996-0008233 U 3/1996
LI DE 3022936 A1 * 12/1981 ..... E06B 1/58

* cited by examiner

FILLING MATERIAL, WINDOW AND DOOR SET, AND FILLING METHOD

TECHNICAL FIELD

The present invention relates to a filling material, a window and door set, and a filling method, and, more particularly, to a filling material, a window and door set, and a filling method for easily filling a gap (or pointing) between members in a construction site or a construction field.

BACKGROUND ART

Generally, there is a gap at a connection portion or a joint portion between members in a building or a structure. Further, in a case that a frame of a window and door set, that is, a frame of a window and/or a frame of a door, or a pipe of every kind is installed at an opening of a structural member, there is a gap between the structural member and the frame of the window and door set or between the structural member and the pipe. Generally, a process for filling a gap of the building is called a filling or a pointing.

A foam-in-place method is the best filling method among methods currently known. In the foam-in-place method, a liquefied foaming agent is foamed and the volume of the foaming agent expands, and thereby filling a gap. The liquefied foaming agent is composed of two kinds of chemicals A&B that are petrochemicals. When the two kinds of chemicals are reacted with each other, they are cured in a state that they inflate, and thus, foam having cells or bubbles is formed. The chemical generally used for the foaming agent may be a polyurethane type foaming agent (A: isocyanate, B: polyol). The foam-in-place method may be classified into a method using a mono-fluid type (or one-component type) foaming agent and a method using a two-fluid type (or two-component type) forming agent according to a specific method.

In the mono-fluid type foaming agent, the A&B solutions are put in one can and the A&B solutions are pre-reacted in the can. The mono-fluid type foaming agent is a moisture-curing material that is foamed when it is exposed to moisture. The mono-fluid type foaming agent is cured when it is exposed to the moisture of an air. It is convenient to use the mono-fluid type foaming agent. However, since a foaming velocity of the mono-fluid type foaming agent is low, it is difficult to apply to a vertical portion, a structure of cells of the foamed foam is poor or loose and air tightness property is low. That is, there are various problems in applications and performances when the mono-fluid type foaming agent is sued. Further, because the mono-fluid type foaming agent is the moisture-curing material, the foaming and the curing are slowly induced from a surface where the reaction is firstly induced. An inside foaming is performed after a completion of a surface forming, and thus, the inside foaming may be non-ideally generated.

The method using the two-fluid type foaming agent is used for solving the above problems of the mono-fluid type foaming agent. When the two-fluid type foaming agent is used, the A solution and the B solution that were entirely separated are mixed and reacted, and are used by a spray coat at a construction site. The two-fluid type foaming agent solves the problems of the mono-fluid type foaming agent in applicability in the construction site and quality. However, since a drum of a raw material, a mixing and foaming apparatus, and a power apparatus (or an apparatus for driving) (for example, an air compressor, electricity, or so on) should be transferred to the construction site, workability of the two-fluid type foaming agent is remarkably low, compared with the mono-fluid type foaming agent. The transfer of the apparatuses is difficult, and thus, the transportation fare is high and a huge working space is necessary. Also, protecting or curing is necessary when the two-fluid type foaming agent is used.

DISCLOSURE

Technical Problem

The invention has been made in view of the above problems, and it is an object of an embodiment of the invention to provide a filling material, a window and door set, and a filling method being able to easily fill a gap between members in a construction site or in a construction field without an additional apparatus.

It is another object of an embodiment of the invention to provide a filling material, a window and door set, and a filling method having heat insulation property, sound insulating property, fireproofing property, and fire protecting property by filing a gap between members.

It is yet another object of an embodiment of the invention to provide a filling material, a window and door set, and a filling method being able to maintain a construction site to be clean, not using a liquefied foaming agent of chemicals.

It is still another object of an embodiment of the invention to provide a filling material, a window and door set, and a filling method where an additional finishing treatment after filling a gap between members is not necessary.

Technical Solution

A filling material according to an embodiment of the invention includes: an outer cover material having elasticity; an expansion material being inserted into an inside of the outer cover material, wherein the expansion material being compressed when the inside of the outer cover material is evacuated; a nozzle being provided at one end of the outer cover material, wherein air is evacuated from the inside of the outer cover material or air is injected to the inside of the outer cover material to expand the outer cover material through the nozzle; and a stopper for blocking the nozzle in a state that the inside of the outer cover material is evacuated to maintain the inside of the outer cover material to be vacuous.

The outer cover material may include at least one of nylon, urethane, latex, and flexible PVC (flexible polyvinyl chloride).

The outer cover material may be waterproof and vapor-proof.

The expansion material may include at least one of glass wool, mineral wool, aerogel, polyester fiber having heat insulation property, fireproofing property, and fire protecting property.

The outer cover material may have a penetration hole where a fixing member penetrates when the filling material is used in a construction site.

The filling material may further include a stretch-prevention member attached at a side of the outer cover material, wherein the stretch-prevention member preventing the outer cover material from stretching in a direction when the expansion material expands.

The outer cover material may include a flexible portion and a rigid portion coupled to each other, the flexible portion may be stretched when the expansion material is expanded, and the rigid portion may be not stretched when the expansion material is expanded.

A heat-insulating filling method according to an embodiment of the invention includes steps of: (a) inserting an expansion material into an inside of an outer cover material having elasticity; (b) compressing the expansion material by evacuating the outer cover material; (c) forming a filling material by blocking a nozzle provided at one side of the outer cover material through using a stopper and maintaining the inside of the outer cover material to be vacuous; (d) inserting the filling material between members of a building or a structure; and (e) filling a gap between the members of the building or the structure with the filling material by opening the stopper to flow air through the nozzle and expanding the expansion material through the air.

The filling method may further include attaching a stretch-prevention member for preventing the outer cover material from stretching in one direction, before the step of (a).

The outer cover material may include at least one of nylon, urethane, latex, and flexible PVC.

The expansion material may include at least one of glass wool, mineral wool, aerogel, polyester fiber having heat insulation property.

Advantageous Effects

According to a filling material, a window and door set, and a heat-insulating filling method, a gap between members in a construction site or in a construction field can be easily filled without an additional apparatus.

Also, sound insulation property, and optionally fireproofing property if it is necessary, as well as heat insulation property can be achieved at the same time.

In addition, a liquefied foaming agent of chemicals is not used, and thus, a construction site can be maintained to be clear and a quality variation due to circumstances can be prevented.

Further, an additional finishing treatment after filling a gap between members is not necessary.

DETAILED DESCRIPTIONS OF THE EMBODIMENTS

Hereinafter, a filling material, a window and door set (a window and/or a door) (windows and doors, or fittings), and a filling method will be described in detail with reference to the accompanying drawings.

Figure 1:
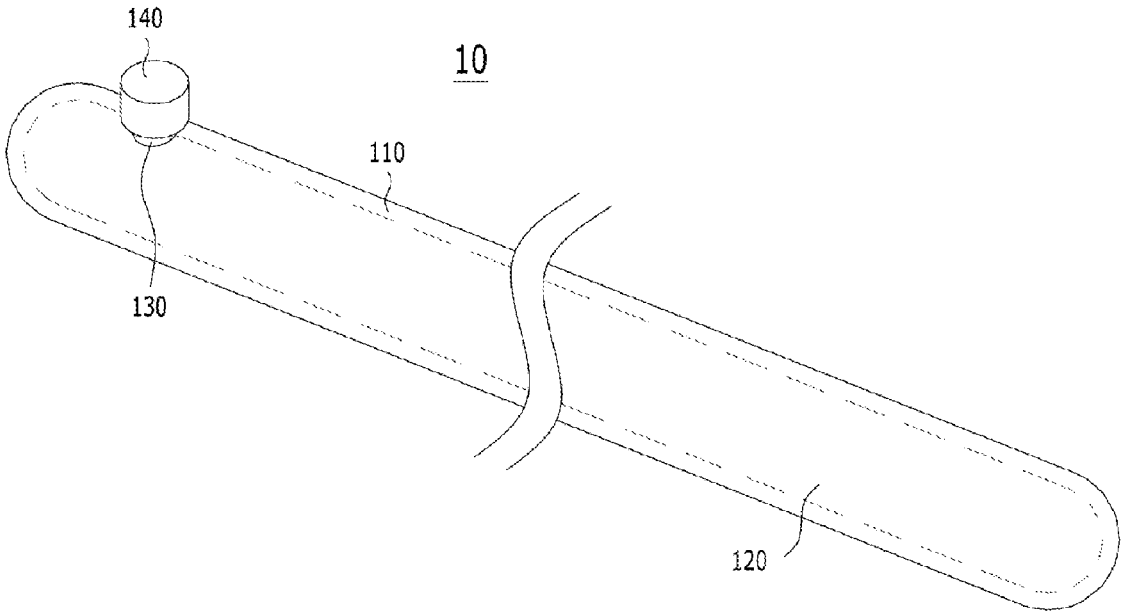
FIG. 1 is a perspective view of a filling material according to an embodiment of the invention.
Figure 2:
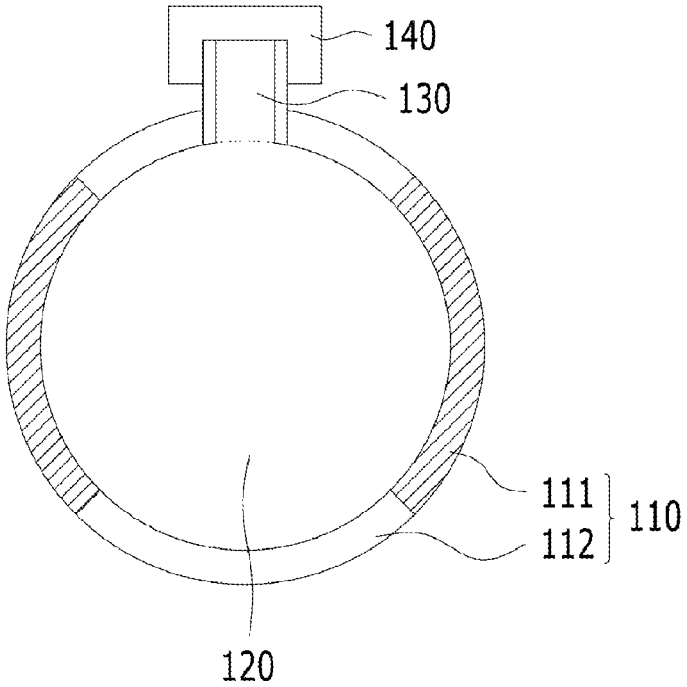
FIG. 2 is a cross-sectional view of the filling material shown in FIG. 1.

FIG. 1 is a perspective view of a filling material according to an embodiment of the invention, and FIG. 2 is a cross-sectional view of the filling material shown in FIG. 1.

A filling material 10 according to an embodiment of the invention includes an outer cover material 110 having elasticity and an expansion material 120 being inserted into an inside of the outer cover material 110. The expansion material 120 is compressed when the outer cover material 110 is evacuated.

Also, the filling material 10 includes a nozzle 130 and a stopper 140. The nozzle 130 is provided at one end of the outer cover material 110. Air is evacuated from the inside of the outer cover material 110 or air is injected to the inside of the outer cover material 110 to expand the outer cover material 110 through the nozzle 130. The stopper 140 blocks the nozzle 130 to maintain the inside of the outer cover material 110 to be vacuous when the inside of the outer cover material 110 is evacuated.

The outer cover material 110 may have a shape of a long tube or the like. The outer cover material 110 may have a cross-section of one of various shapes, such as a circle, a quadrangle, and so on.

The outer cover material 110 may be formed of a material having elasticity so that a volume of the outer cover material 110 can increase or decrease according to an air inflow to the inside of the outer cover material 110 or an air discharge from the outer cover material 110. In addition, the outer cover material 110 may be formed of a material being waterproof and vaporproof so that the outer cover material 110 can protect the expansion material 120 being inserted into the outer cover material 110 and the filling material 10 can be waterproof and vaporproof when the filling material 10 is used.

Nylon, urethane, latex, flexible PVC (flexible polyvinyl chloride), or so on may be used as a material of the outer cover material 110.

The expansion material 120 inserted into the inside of the outer cover material 110 may be formed of a material which volume is largely varied according to a pressure variation of the inside of the outer cover material 110 and which is adiabatic (or has heat insulation property). Also, the expansion material 120 may be formed of a material for securing fireproofing property and fire protecting property when the filling material 10 is used.

Glass wool, mineral wool, aerogel, polyester fiber, or so on may be used as a material of the expansion material 120.

A volume of the expansion material 120 decreases when the expansion material 120 is compressed by the evacuation, and the compressed expansion material 120 is recovered to have an initial volume when the compressing force disappears.

The nozzle 130 is provided at the end of the outer cover material 110. The air is evacuated from the inside of the outer cover material 110 through the nozzle 130 or the air is injected to the inside of the outer cover material 110 to expand the outer cover material 110 through the nozzle 130. A vacuum pump connected to the nozzle 130 may draw or suck the air of the inside of the outer cover material 110. The outer cover material 110 contracts or shrinks when the air of the inside of the outer cover material 110 is drawn or sucked.

When the outer cover material 110 contracts, the expansion material 120 inserted into the inside of the outer cover material 110 is compressed by the outer cover material 110 and the volume of the expansion material 120 decreases. For example, when the expansion material 120 is compressed, the volume of the expansion material 120 may be one third to one fifth of the initial volume of the expansion material 120.

When the nozzle 130 is blocked by the stopper 140 in a state that the inside of the outer cover material 110 is evacuated to be vacuous, the inside of the outer cover material 110 is maintained to be vacuous and the expansion material 120 inside the outer cover material 110 is maintained to have a contracted or shrunk state. Accordingly, the filling material 10 is manufactured.

The filling material 10, which is manufactured in the above, is used for filling a gap between members in a construction site or in a construction field.

When the gap between the members is filled with the filling material 10 in a construction site, the filling material 10 is first inserted into the gap between the members. And then, the stopper 140 blocking the nozzle 130 is open. Then, the air inflows into the outer cover material 110 through the nozzle 130 and the expansion material 120 inflates. As the expansion material 120 inside the outer cover material 110 inflates, the outer cover material 110 having the elasticity inflates also.

Meanwhile, referring to FIG. 2, the outer cover material 110 includes a flexible portion 111 and a rigid portion 112 coupled to each other. The flexible portion 111 is stretched when the expansion material 120 is expanded, and the rigid portion 112 is not stretched when the expansion material 120 is expanded. In this instance, the flexible portion 111 and the rigid portion 112 may be adhered to each other by a heat welding (or a heat fusion) and so on. In FIG. 2, it is shown that a pair of flexible portions 111 face each other, and a pair of rigid portions 112 face each other. However, the invention is not limited. Thus, the flexible portion 111 and the rigid portion 112 may be adhered to have a shape different from the shape shown in FIG. 2.

That is, when the expansion material 120 expands, the flexible portion 111 is stretched and expanded, while the rigid portion 112 is rarely expanded. Accordingly, the filling material 10 expands in a thickness direction, and thus, the filling material 10 can be expanded in one direction.

The filling material 10 may be modified to have various shapes. Hereinafter, filling materials according to other embodiments of the invention will be described. The elements of following embodiments the same as or extremely similar to those of the above embodiment will be designated by the same reference numerals in the above embodiment. Also, the descriptions regarding the elements of following embodiments the same as or extremely similar to those of the above embodiment will be omitted.

Figure 3:
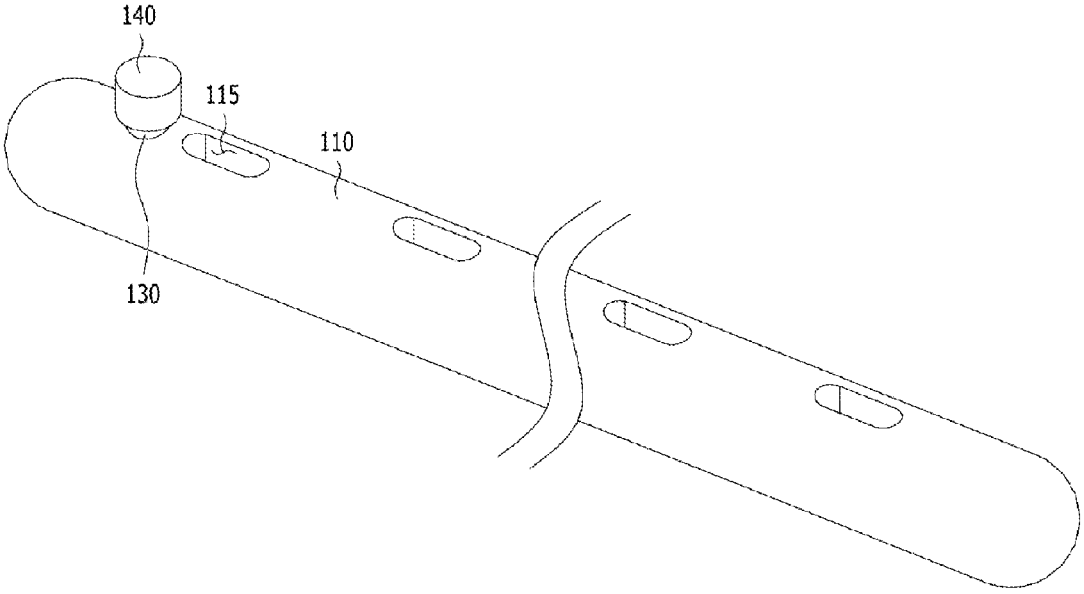
FIG. 3 is a perspective view of a filling material according to another embodiment of the invention.

FIG. 3 is a perspective view of a filling material according to another embodiment of the invention.

As shown in FIG. 3, an outer cover material 110 of a filling material 10 according to another embodiment of the invention has a penetration hole 115 where a fixing member penetrates when it is used in a construction site.

When a window and door set (windows and doors, or fittings), which is a window, a door, or a window and a door, is installed at an opening or the like formed at a wall, the window and door set or the like is fixed by using the fixing member such as a bracket, and then, the gap between the window and door set and an end of the wall is filled with the filling material 10.

In this instance, when the gap between the window and door set and the end of the wall is filled with the filling material 10 of the invention, the fixing member such as the bracket penetrates through the penetration hole 115. After that, the stopper 140 is open, and then, the expansion material inflates. Accordingly, the filling material 10 can fill the gap between the window and door set and the end of the wall without interference due to the fixing member.

Figure 4:
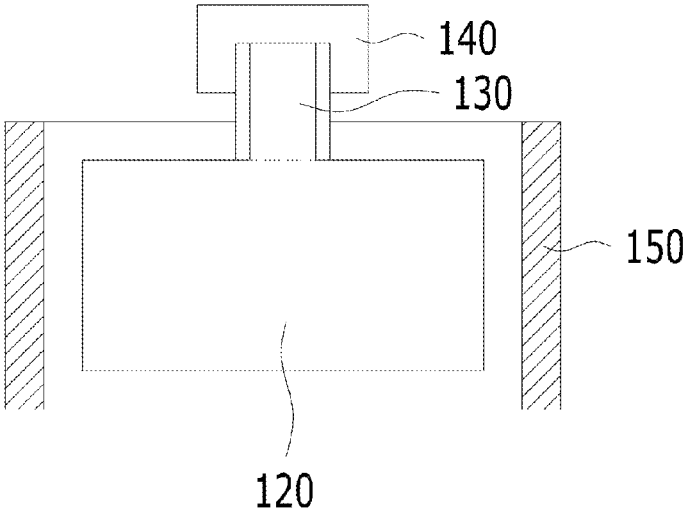
FIG. 4 is a perspective view of a filling material according to yet another embodiment of the invention.

FIG. 4 is a perspective view of a filling material according to yet another embodiment of the invention.

As shown in FIG. 4, in a filling material 10 according to yet another embodiment of the invention, a whole portion of an outer cover material 110 is formed of a flexible material that is stretched when the expansion material 120 expands. A stretch-prevention member 150 may be attached at a side of the outer cover material 110. The stretch-prevention member 150 prevents the outer cover material 120 from stretching in a direction when the expansion material 120 expands.

In FIG. 4, it is exemplified that the filling material 10 has a cross section of a quadrangle and the stretch-prevention members 150 are attached at both sides of the outer cover material 110, respectively. Then, when the filling material 10 expands in a thickness direction, the filling material 10 is not expands in the direction where the stretch-prevention member 150 is attached, and thus, the filling material 10 is expanded in one direction.

On the other hand, the filling material of the invention may be used in various places and in various uses or applications.

Hereinafter, an example where the filling material of the above embodiment is installed at various members of a building or a structure will be described.

Figure 5:
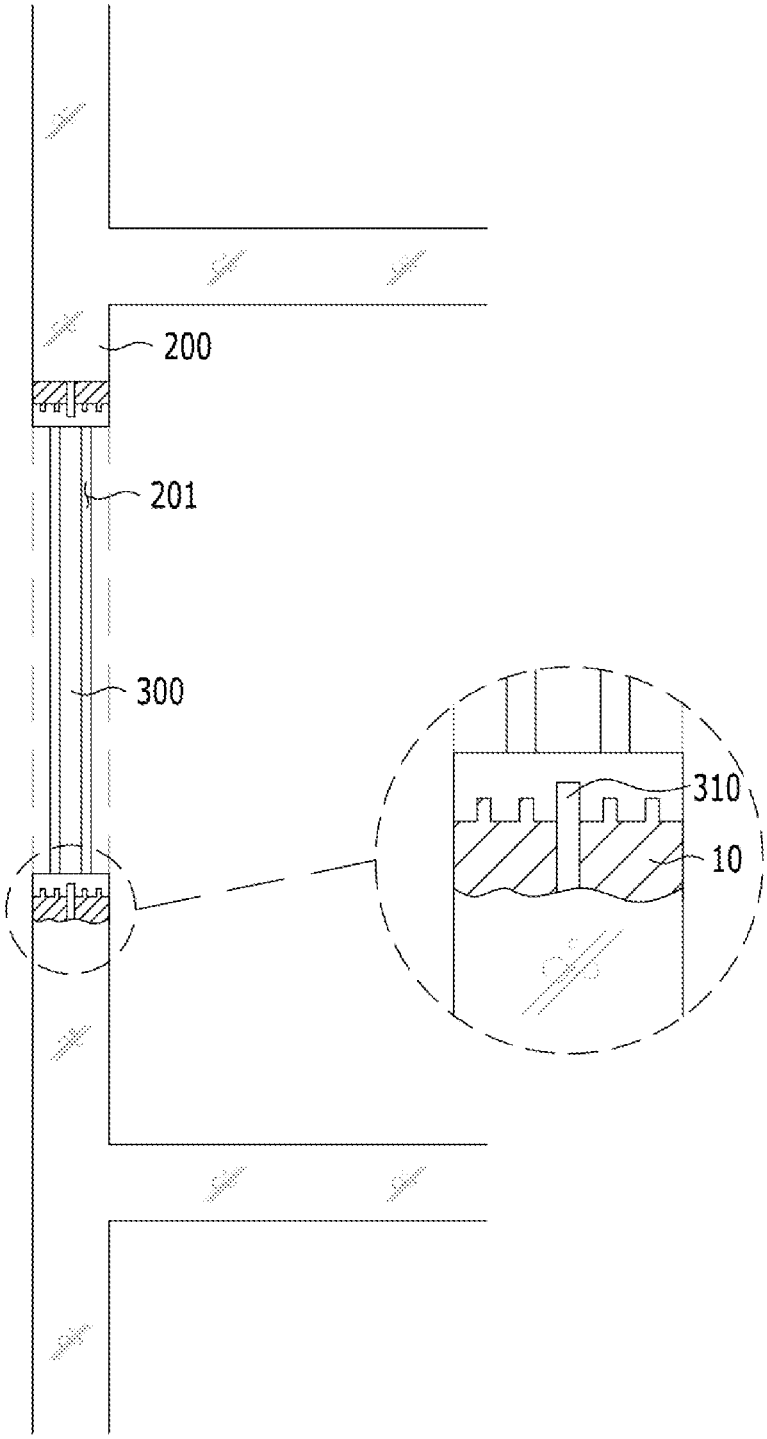
FIG. 5 is a cross-sectional view illustrating a state that a filling material according to an embodiment of the invention is installed between a window and door set and a wall.
Figure 6:
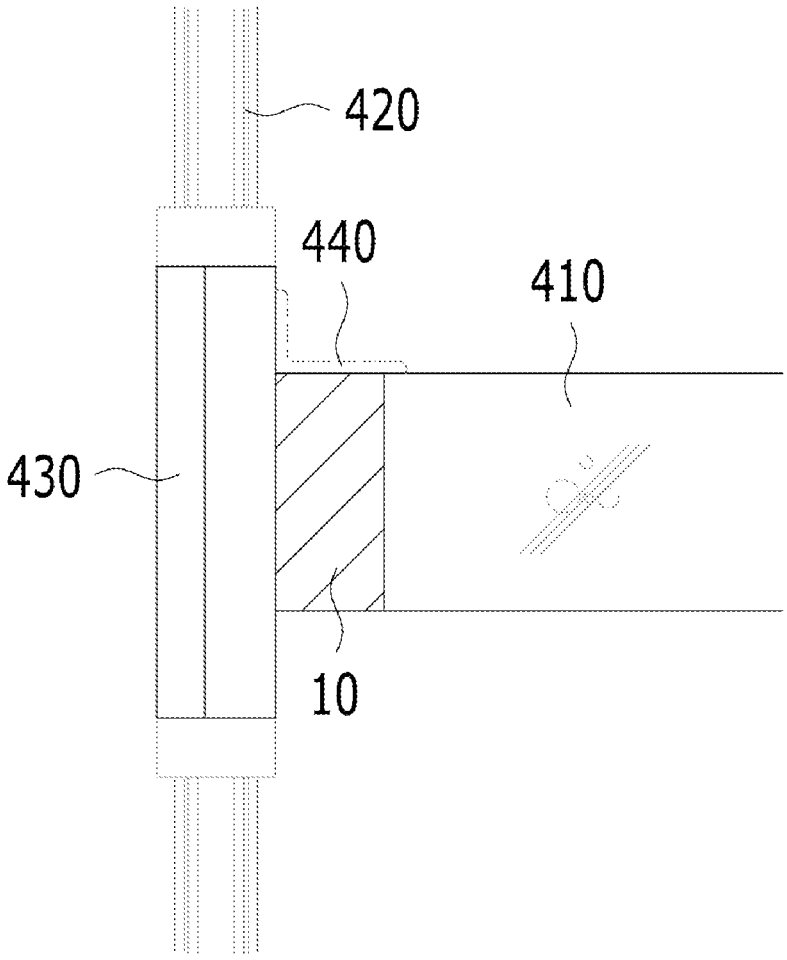
FIG. 6 is a cross-sectional view illustrating a state that a filling material according to an embodiment of the invention is installed between floors.
Figure 7:
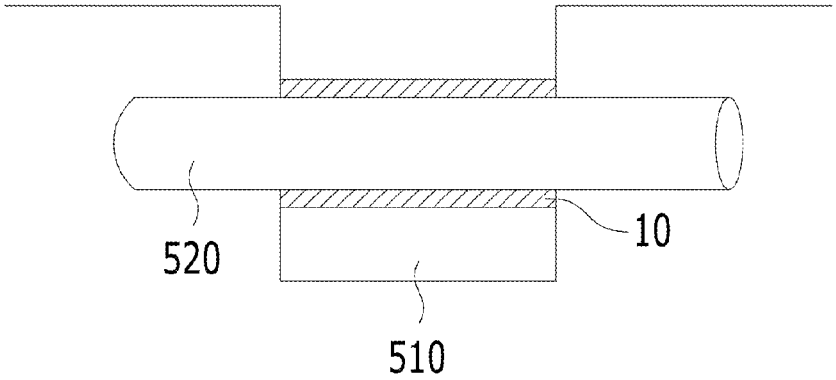
FIG. 7 is a cross-sectional view illustrating a state that a filling material according to an embodiment of the invention is installed between a structural member and a pipe.

FIG. 5 is a cross-sectional view illustrating a state that a filling material according to an embodiment of the invention is installed between a window and door set and a wall. FIG. 6 is a cross-sectional view illustrating a state that a filling material according to an embodiment of the invention is installed between floors. FIG. 7 is a cross-sectional view illustrating a state that a filling material according to an embodiment of the invention is installed between a structural member and a pipe.

As shown in FIG. 5, when a window and door set (windows and doors, or fitting) 300, that is, a window, a door, or an window and a door, is installed at an opening 201 formed at a wall 200, a size of the opening 201 is larger than a size of the window and door set 300 in order to conveniently install the window and door set 300.

Therefore, a gap is formed between the window and door set 300 and the end of the wall 200, and the gap is filled with the filling material 10 according to the embodiment of the invention. Since the filling material 10 is a long tube, the gaps of four sides between the end of the wall 200 and the window and door set 300 can be continuously filled with the filling material 10 along the four sides.

Meanwhile, the end of the wall 200 may be not flat due to a problem generated when it is constructed, and the end of the window and door set 300 may be not flat. Because the outer cover material 110 of the filling material 10 has high elasticity, the outer cover material 110 fills the gap formed at the end of the wall 200 or formed at the end of the window and door set 300 when the filling material 10 expands. Thus, the filling material 10 can entirely fills the gap between the end of the wall 200 and the window and door set 300.

In addition, when the filling material 10 expands, the filling material 10 expands in a vertical direction shown in FIG. 5, and the filling material 10 does not expand in a horizontal direction shown in FIG. 5. In order to this, when the filling material 10 shown in FIG. 2 is used, the flexible portions 112 may be positioned in the vertical direction and the rigid portions 111 may be positioned in the horizontal direction. Also, when the filling material 10 shown in FIG. 4 is used, the stretch-prevention member 150 may be positioned in the horizontal direction.

Accordingly, when the filling material 10 expands to the thickness direction, the filling material 10 expands only in the vertical direction. Thereby, the gap between the end of the wall 200 and the window and door set 300 can be filled with the filling material 110. Also, the filling material 10 can be prevented from expanding in the horizontal direction and undesirably protruding or projecting to the outside in the horizontal direction.

Meanwhile, when the window and door set 300 is fixed to the end of the wall by a fixing member 310 such as a bracket or so on, the filling material 10 shown in FIG. 3 may be used. In this instance, the fixing member 310 such as the bracket or so on penetrates through the penetration hole 115 of the filling material 10, and then, the stopper 140 is open and thus the expansion material 120 inflates. Accordingly, the filling material 10 can fill the gap between the window and door set 300 and the end of the wall 200 without interference due to the fixing member 310.

The outer cover material 110 of the filling material 10 according to the embodiment of the invention is waterproof and vaporproof, and the expansion material 120 is adiabatic or has heat insulation property. Therefore, when the gap between the window and door set 300 and the end of the wall 200 is filled with the filling material 10 according to the embodiment of the invention, air tightness property and water tightness property as well as the heat insulating property can be secured at the gap between the window and door set 300 and the wall 200.

As shown in FIG. 6, a filling material according to an embodiment of the invention may be installed between floors of a building or a structure.

In a building or a structure, a structural member such as a curtain wall 420 may be coupled to a slab 410 or so on for dividing floors. In this instance, a gap may exist between the slab 410 and the curtain wall 420. If the gap is not blocked, noise may be transferred through a floor and a fire may spread to another floor when the fire breaks out at one floor.

Therefore, when the slab 410 and the curtain wall 420 are coupled to each other, the gap between slab 410 and the curtain wall 420 should be blocked by a material having sound insulation property, and fireproofing property and fire protecting property.

As shown in FIG. 6, when the gap between the slab 410 and the curtain wall 420 is filled with the filling material 10 according to the embodiment of the invention, the gap can be easily filled by the filling material 10.

Also, since the outer cover material 110 of the filling material 10 according to the embodiment of the invention has high elasticity and the filling material 10 entirely fills the gap, the superior sound insulation property can be secured. In addition, the expansion material 120 is formed of an inorganic fiber such as glass wool, mineral wool, or so on, and thus, the superior fireproofing property and fire protecting property can be secured.

As shown in FIG. 7, a filling material according to an embodiment of the invention may be installed between a structural member and a pipe.

In a building or a structure, a plurality of pipes 520 are installed. For example, the pipe 520 may penetrate a structural member 510 of a building or a structure. In order to install the pipe 520, a hole is formed at the structural member 510, and then, the pipe 520 penetrates through the hole.

On the other hand, in order to easily install the pipe 520 to penetrate through the hole of the structural member 510, a size of the hole of the structural member 510 is larger than a size of a diameter of the pipe 520. Therefore, there is a gap between the structural member 510 and the pipe 520, and the gap should be filled with a material of fireproofing property and fire protecting property.

As in the above, the gap between the structural member 510 and the pipe 520 can be easily filled with the filling material 10 according to the embodiment of the invention, and the fireproofing property and fire protecting property can be secured.

Figure 8:
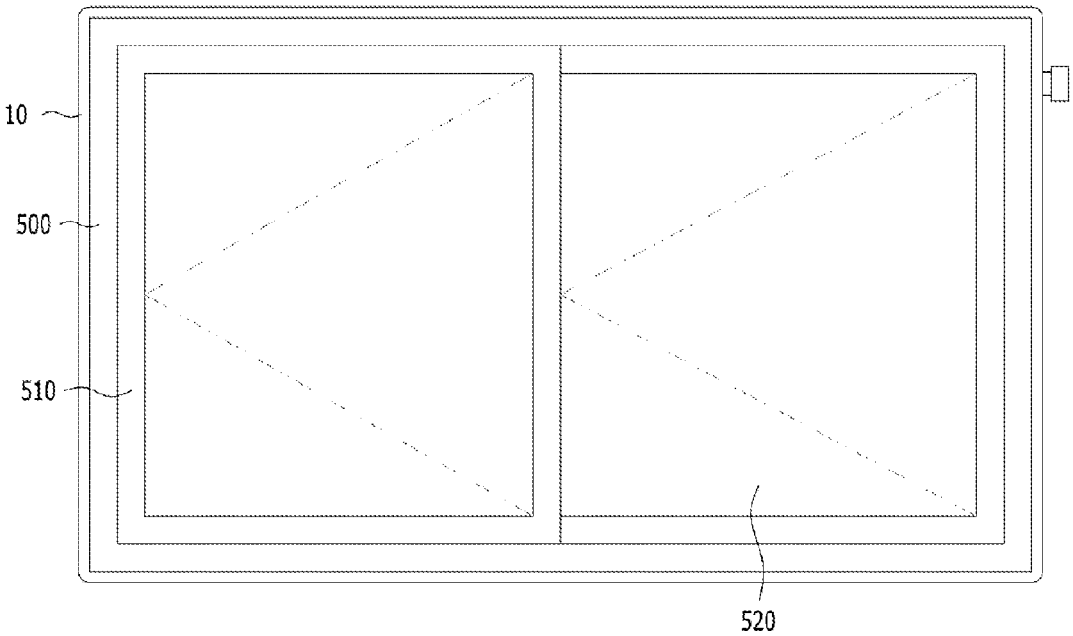
FIG. 8 is a cross-sectional view of a window and door set where a filling material according to an embodiment of the invention is installed.

FIG. 8 is a cross-sectional view of a window and door set where a filling material according to an embodiment of the invention is installed.

In FIG. 5, it is exemplified that the gap between the end of the wall 200 and the window and door set 300 is filled by using the filling material 10 according to an embodiment of the invention. However, the invention is not limited thereto. For example, a window and door set 500 integrally equipped with the filling material 10 according to the embodiment of the invention may be manufactured in order to omitting a process for inserting the filling material 10 between the end of the wall 200 and the window and door set 300.

Generally, the window and door set 500 is composed of a window frame (or a door frame) 510 and a window (or a door) 520, and the filling material 10 according to the embodiment of the invention may be attached to the window frame 510 when the window and door set is manufactured at a factory. Then, a process for filling the filling material 10 between the end of the wall 200 and the window and door set 300 can be omitted.

When the window and door set 500 integrally equipped with the filling material 10 is used, a stopper 140 of the filling material 10 is open in a state that the window and door set 500 is installed at an opening formed at the wall 200. Then, the gap between the end of the wall 200 of the window and door set 500 can be easily filled with the filling material 10.

Next, a filling method using a filling material according to the embodiment in the construction site will be described.

Figure 9:
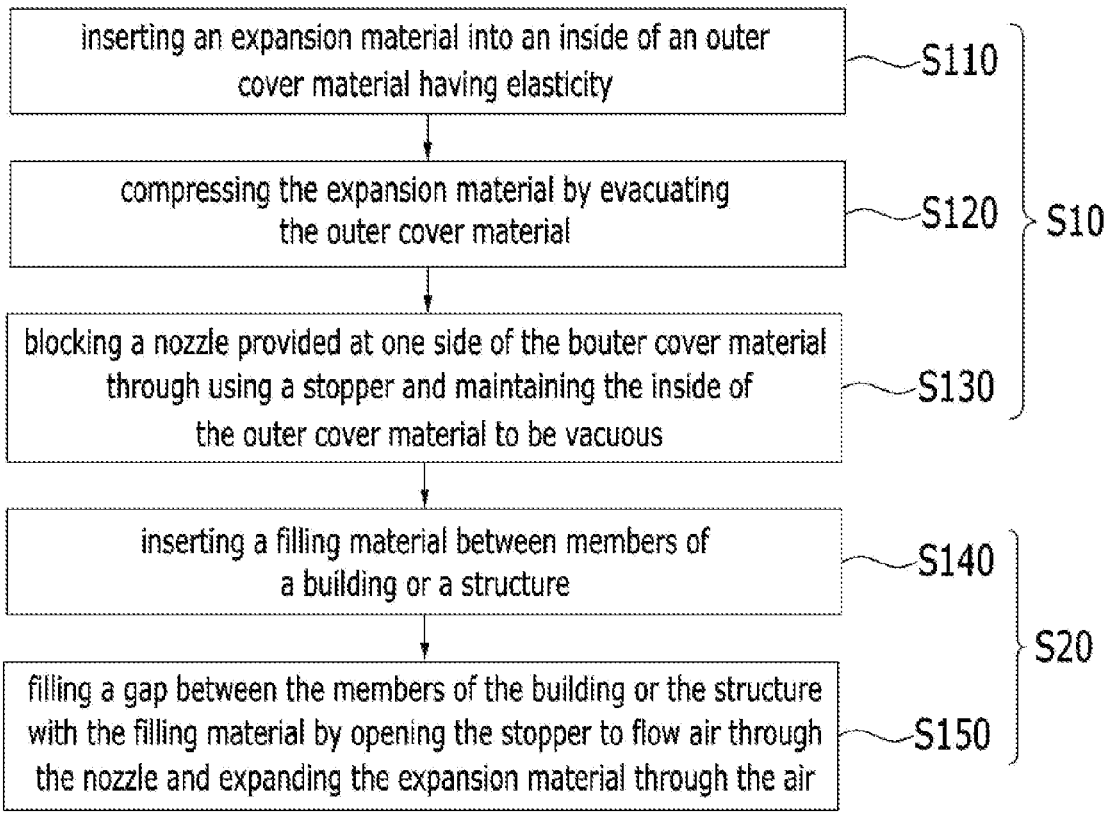
FIG. 9 is a flow chart of a filling method using a filling material according to an embodiment of the invention.

FIG. 9 is a flow chart of a filling method using a filling material according to an embodiment of the invention.

A filling method according to an embodiment of the invention may be largely divided into a step S10 of manufacturing a filling material 10 and a step 20 of installing the filling material 10 in a construction site.

First, the step S10 of manufacturing the filling material 10 will be described.

The step S10 of manufacturing the filling material 10 includes an (a) step S110 of inserting an expansion material 120 having heat insulation property into an inside of an outer cover material 110 having elasticity, a (b) step S120 of compressing the expansion material 120 by evacuating the outer cover material 110, and a (c) step S130 of maintaining the inside of the outer cover material 110 to be vacuous by blocking a nozzle 130 provided at one side of the outer cover material 110 through using a stopper 140.

In the (a) step, when the expansion material 120 is inserted into the inside of the outer cover material 110, the expansion material 120 is inserted into the inside of the outer cover material 110 in a state that one end of the outer cover material 110 is open, and then, the open one end of the outer cover material 110 is sealed by an ultrasonic fusion or the like.

In the (b) step, in order to evacuate the outer cover material 110 to the vacuum state, a vacuum pump is connected to the nozzle 130 provided at the side of the outer cover material 110, and the air of the inside of the outer cover material 110 is drawn or sucked by the vacuum pump. Therefore, negative pressure is applied to the inside of the outer cover material 110.

In the (c) step, when the nozzle 130 provided at the side of the outer cover material 110 is blocked by the stopper 140, the stopper 140 may have a structure being able to completely cutting off air when the stopper 140 is coupled to the nozzle 130 so that the air does not inflow through the nozzle 130.

Meanwhile, when an entire portion of the outer cover material 110 is formed of a flexible material, a step of attaching a stretch-prevention member 150 for preventing a stretch of the outer cover material 110 in a direction may be included before the (a) step, in order to expand the outer cover material 110 in only one direction when the outer cover material 110 expands in a thickness direction.

Next, the step S20 of installing the filling material 10 in the construction site will be described.

The step S20 of installing the filling material 10 in the construction site include a (d) step S140 of inserting the filling material 10 between members of a building or a structure; and an (e) step S150 of filling a gap between the members of the building or the structure with the filling material 10 by opening the stopper 140 to flow air through the nozzle 130 and expanding the expansion material 120 through the air.

In the (d) step, one end of the filling material 10 and the other end of the filling material 10 may overlap each other.

In the (e) step, the stopper 140 is open and the air inflows through the nozzle 130. In this instance, the predetermined air inflows through the nozzle 130 and the expansion material 120 expands to have the predetermined volume, and then, the nozzle 130 is blocked through using the stopper 140 and thus the air inflow through the nozzle 130 can be prevented.

Therefore, the air and the moisture can be prevented from permeating or penetrating to the inside of the outer cover material 110. Thus, heat insulation property and durability can be enhanced.

As in the above, according to the filling method using the filling material according to the embodiment of the invention, the gap between the members can be easily filled without an additional equipment or apparatus in the construction site. Also, sound insulation property and fireproofing property as well as heat insulation property can be simultaneously achieved.

The above described features, configurations, effects, and the like are included in at least one of the embodiments of the present invention, and should not be limited to only one embodiment. In addition, the features, configurations, effects, and the like as illustrated in each embodiment may be implemented with regard to other embodiments as they are combined with one another or modified by those skilled in the art. Thus, content related to these combinations and modifications should be construed as including in the scope and spirit of the invention as disclosed in the accompanying claims.

The invention claimed is:

1. A filling material comprising: an outer cover material having elasticity;

an expansion material disposed in an inside of the outer cover material, wherein the expansion material is configured to be compressed when air inside of the outer cover material is evacuated;

a nozzle disposed at one end of the outer cover material, wherein the nozzle is configured such that the air is evacuated from the inside of the outer cover material or the air is injected to the inside of the outer cover material to expand the outer cover material through the nozzle; and a stopper for blocking the nozzle in a state that the air inside of the outer cover material is evacuated to maintain the inside of the outer cover material to be vacuous, wherein the outer cover material comprises a flexible portion and a rigid portion coupled to each other in a continuous circumference, wherein the flexible portion is configured to be stretched when the expansion material is expanded, wherein the rigid portion is configured not to be stretched when the expansion material is expanded.

2. The filling material according to claim 1, wherein the outer cover material comprises at least one of nylon, urethane, latex, and flexible PVC (flexible polyvinyl chloride).

3. The filling material according to claim 1, wherein the outer cover material is waterproof and vaporproof.

4. The filling material according to claim 1, wherein the expansion material comprises at least one of glass wool, mineral wool, aerogel, and polyester fiber having heat insulation property, fireproofing property, and fire protecting property.

5. The filling material according to claim 1, wherein the outer cover material has a penetration hole where a fixing member penetrates when the filling material is used in a construction site.

6. The filling material according to claim 1, further comprising:

a stretch-prevention member attached at a side of the outer cover material, wherein the stretch-prevention member is configured for preventing the outer cover material from stretching in a direction when the expansion material expands.

7. A window and door set, wherein the window and door set comprises the filling material according to claim 1.

8. A filling method comprising steps performed in the following order:

(a) disposing an expansion material into an inside of an outer cover material having elasticity;

(b) compressing the expansion material by evacuating the air inside the outer cover material;

(c) forming a filling material by blocking a nozzle disposed at one side of the outer cover material through using a stopper and maintaining the inside of the outer cover material to be vacuous;

(d) inserting the filling material between members of a building structure; and (e) filling a gap between the members of the building or the structure with the filling material by opening the stopper to flow air through the nozzle and expanding the expansion material through the air.

9. The filling method according to claim 8, further comprising:

attaching a stretch-prevention member for preventing the outer cover material from stretching in one direction, before the step of (a).

10. The filling method according to claim 8, wherein the outer cover material comprises at least one of nylon, urethane, latex, and flexible PVC.

11. The filling method according to claim 8, wherein the expansion material comprises at least one of glass wool, mineral wool, aerogel, and polyester fiber having heat insulation property.

12. A window and door set, wherein the window and door set comprises the filling material according to claim 2.

13. A window and door set, wherein the window and door set comprises the filling material according to claim 3.

14. A window and door set, wherein the window and door set comprises the filling material according to claim 4.

15. A window and door set, wherein the window and door set comprises the filling material according to claim 5.

16. A window and door set, wherein the window and door set comprises the filling material according to claim 6.

* * * * *